US009428968B2

(12) United States Patent
Paros et al.

(10) Patent No.: US 9,428,968 B2
(45) Date of Patent: Aug. 30, 2016

(54) ROTARY DRILL BIT WITH CUTTING INSERT HAVING EDGE PREPARATION

(71) Applicant: Kennametal Inc., Latrobe, PA (US)

(72) Inventors: Nicholas J. Paros, Johnstown, PA (US); Stephen M. George, Greensboro, NC (US); Glenn W. Sheffler, Blairsville, PA (US); Don C. Rowlett, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 467 days.

(21) Appl. No.: 13/871,006

(22) Filed: Apr. 26, 2013

(65) Prior Publication Data

US 2014/0318871 A1 Oct. 30, 2014

(51) Int. Cl.
*E21B 10/58* (2006.01)

(52) U.S. Cl.
CPC ..... *E21B 10/58* (2013.01)

(58) Field of Classification Search
CPC ..... E21B 10/58; E21B 10/42; E21B 10/54; E21B 10/52
See application file for complete search history.

(56) References Cited

U.S. PATENT DOCUMENTS

| | | | | |
|---|---|---|---|---|
| 2,689,108 | A | 9/1954 | Haglund | |
| 2,740,611 | A | 4/1956 | Bowen | |
| 3,006,424 | A | 10/1961 | Dahlin et al. | |
| 3,671,075 | A | 6/1972 | Eyre et al. | |
| 4,026,372 | A * | 5/1977 | Hampson | 175/420.1 |
| 4,120,601 | A * | 10/1978 | Benjamin | 408/226 |
| 4,143,920 | A | 3/1979 | Haddock | |
| 4,189,013 | A | 2/1980 | Adams et al. | |
| 4,194,790 | A | 3/1980 | Kenny et al. | |
| 4,449,864 | A | 5/1984 | Haque et al. | |
| 4,550,791 | A | 11/1985 | Isakov | |
| 4,603,751 | A | 8/1986 | Erickson | |
| 4,616,963 | A | 10/1986 | Habert et al. | |
| 4,667,755 | A | 5/1987 | Muller et al. | |
| 4,674,802 | A | 6/1987 | McKenna et al. | |
| 4,678,237 | A | 7/1987 | Collin | |
| 4,787,464 | A | 11/1988 | Ojanen | |

(Continued)

FOREIGN PATENT DOCUMENTS

| | | |
|---|---|---|
| DE | 2619335 | 11/1977 |
| DE | 3315624 | 11/1984 |

(Continued)

OTHER PUBLICATIONS

DE 102014103806., Nov. 23, 2015 First office action DE 102014103806.

*Primary Examiner* — Jennifer H Gay
(74) *Attorney, Agent, or Firm* — Matthew S. Bedsole

(57) ABSTRACT

A rotary drill bit for engaging an earth strata material includes an elongate drill bit body having an axial forward end and an axial rearward end, and a cutting insert attached to the axial forward end of the elongate drill bit body. The cutting insert has an elongate insert body rotatable about a central axis and includes a pair of symmetrical halves symmetrical about the central axis, each symmetrical half including a leading face, a top surface having a relief surface, a T-land surface extending between the leading face and the relief surface and a cutting edge formed at the intersection of the T-land surface and the relief surface. The cutting edge can have a negative axial rake angle. The relief surface can include a primary relief surface and a secondary relief surface.

15 Claims, 15 Drawing Sheets

(56) References Cited

U.S. PATENT DOCUMENTS

| | | | | |
|---|---|---|---|---|
| 4,817,742 | A * | 4/1989 | Whysong | 175/420.1 |
| 4,838,366 | A | 6/1989 | Jones | |
| 4,903,609 | A | 2/1990 | Isakov et al. | |
| 4,913,125 | A | 4/1990 | Bunting et al. | |
| 4,984,944 | A | 1/1991 | Pennington, Jr. et al. | |
| 4,998,574 | A | 3/1991 | Beach et al. | |
| 5,141,367 | A | 8/1992 | Beeghly et al. | |
| 5,147,158 | A | 9/1992 | Riviere | |
| 5,172,775 | A | 12/1992 | Sheirer et al. | |
| 5,184,689 | A | 2/1993 | Sheirer et al. | |
| 5,220,967 | A | 6/1993 | Monyak | |
| 5,297,853 | A | 3/1994 | Sollami | |
| 5,319,855 | A | 6/1994 | Beevers et al. | |
| 5,375,672 | A | 12/1994 | Peay et al. | |
| 5,400,861 | A | 3/1995 | Sheirer | |
| 5,452,628 | A | 9/1995 | Montgomery, Jr. et al. | |
| 5,467,837 | A | 11/1995 | Miller et al. | |
| 5,482,124 | A * | 1/1996 | Haussmann et al. | 175/415 |
| 5,996,715 | A | 12/1999 | Peay et al. | |
| 6,053,263 | A | 4/2000 | Meiners | |
| 6,145,606 | A | 11/2000 | Haga | |
| 6,173,798 | B1 | 1/2001 | Bryant et al. | |
| 6,174,111 | B1 * | 1/2001 | Anjanappa et al. | 408/1 R |
| 6,260,637 | B1 * | 7/2001 | Haussmann et al. | 175/420.1 |
| 6,260,638 | B1 | 7/2001 | Massa et al. | |
| 6,270,164 | B1 | 8/2001 | Seitle et al. | |
| 6,270,297 | B1 | 8/2001 | Fang et al. | |
| 6,446,741 | B1 * | 9/2002 | Kersten et al. | 175/428 |
| 6,595,305 | B1 | 7/2003 | Dunn et al. | |
| 6,860,344 | B2 | 3/2005 | Bise et al. | |
| 6,945,340 | B2 | 9/2005 | Bise et al. | |
| 6,976,549 | B2 * | 12/2005 | Haussmann et al. | 175/420.1 |
| 7,001,120 | B2 * | 2/2006 | Moser et al. | 408/225 |
| 7,168,511 | B2 | 1/2007 | Woods et al. | |
| 7,393,061 | B2 | 7/2008 | Hesse et al. | |
| 7,401,667 | B2 * | 7/2008 | Duscha et al. | 175/323 |
| 7,455,129 | B2 * | 11/2008 | Widmann et al. | 175/385 |
| 7,578,080 | B2 | 8/2009 | Stoetzer et al. | |
| 8,002,054 | B2 | 8/2011 | Swope et al. | |
| 8,020,591 | B2 | 9/2011 | Kappel et al. | |
| 8,136,887 | B2 | 3/2012 | Hall et al. | |
| 8,789,894 | B2 | 7/2014 | Lucek et al. | |
| 9,085,947 | B2 * | 7/2015 | George et al. | |
| 2003/0077134 | A1 * | 4/2003 | Moser et al. | 408/231 |
| 2003/0159855 | A1 * | 8/2003 | Haussmann et al. | 175/420.1 |
| 2004/0089481 | A1 * | 5/2004 | Bise et al. | 175/427 |
| 2006/0065446 | A1 | 3/2006 | Woods et al. | |
| 2007/0151769 | A1 | 7/2007 | Slutz et al. | |
| 2007/0169965 | A1 * | 7/2007 | Moser et al. | 175/420.1 |
| 2010/0187019 | A1 | 7/2010 | Swope et al. | |
| 2010/0316456 | A1 | 12/2010 | George | |
| 2012/0241223 | A1 | 9/2012 | Bise et al. | |
| 2014/0318870 | A1 * | 10/2014 | George et al. | 175/427 |
| 2014/0318871 | A1 * | 10/2014 | Paros et al. | 175/427 |
| 2014/0318872 | A1 * | 10/2014 | Paros et al. | 175/427 |

FOREIGN PATENT DOCUMENTS

| | | | |
|---|---|---|---|
| DE | 19514454 | | 10/1996 |
| DE | 19734093 | A1 | 5/1998 |
| DE | 10208631 | A1 | 9/2003 |
| DE | 102004047469 | A1 | 4/2006 |
| DE | 202010005228 | | 10/2011 |

* cited by examiner

ROTARY DRILL BIT WITH CUTTING INSERT HAVING EDGE PREPARATION

BACKGROUND OF THE INVENTION

The invention pertains generally to an excavating tool such as, for example, a rotary drill bit useful for drilling through various earth strata. More specifically, the invention pertains to a rotary drill bit with a cutting insert such as, for example, a roof drill bit useful for drilling bore holes in an underground mine.

The expansion of an underground mine, such as for example, a coal mine, requires digging a tunnel. Initially, this tunnel has an unsupported roof. Because the roof is not supported, there is an increased chance for a mine cave that, of course, adds to the hazards of underground coal mining. Furthermore, an unsupported roof is susceptible to rock and debris falling from the roof. Falling rock and debris can injure workers as well as create hazardous clutter on the floor of the tunnel. In order to support and stabilize the roof in an underground tunnel, bore holes are drilled in the roof, i.e., earth strata.

The apparatus used to drill these holes typically comprises a drill with a long shaft, i.e., drill steel, attached to the drill. A roof drill bit is detachably mounted to the drill steel at the distal end thereof. In certain roof drill bits, a hard cutting insert is mounted on a body of the roof drill bit. The roof drill bit is then pressed against the roof, and the drilling apparatus operated so as to drill a bore hole in the roof. The bore holes extend between about two feet and about twenty feet into the roof depending upon the particular situation. The roof support members, such as roof panels, are then attached to roof bolts. In one alternative procedure, these bore holes are filled with resin and roof bolts are fixed within the bore holes. In another alternative procedure, the roof bolts use mechanical expander shells to affix the roof bolts in the bore holes. The end result of using either procedure is a roof which is supported, and hence, is of much greater stability than the unsupported roof. This reduces the hazards associated with underground mining. The roof bolting process is considered to be an essential underground mining activity.

Roof bolting accounts for the largest number of lost time injuries in underground mining. During the roof bolting process, the roof is unsupported so that it does not have optimum stability. Furthermore, the roof bolting process exerts stresses on the roof so as to further increase the safety hazards during the roof bolting process. Thus, a decrease in the overall time necessary to bore holes reduces the time it takes to complete the roof bolting process. This is desirable since it contributes to the overall speed, efficiency and safety of the roof bolting process. Thus, many solutions have been proposed to decrease the overall time to complete the drilling of the necessary bore holes. For example, roof drilling bits with various cutting inserts and various cutting geometries have been developed. Efforts have also been made to increase the overall useful life of roof drilling bits.

FIGS. 1 and 1A set forth an example of a known cutting insert 2 (for use with a roof drilling bit) having a leading face 4, a top surface 6 that includes a primary relief surface 7 adjacent to the leading face 4 and secondary relief surface 8. The leading face 4 and the primary relief surface 7 intersect at an angle M (90 degrees or less) to form a cutting edge 9 which results in a positive or neutral axial rake angle N. However, it has been determined that this configuration results in a large amount of stress on the cutting edge 9 which in turn leads to the failure of the cutting edge 9 (e.g. as a result of breaking or chipping of the cutting edge) and, thus, the cutting insert 2 needing to be replaced.

Accordingly, there is a need for improved roof drilling bits that overcome disadvantages, limitations and shortcomings of known roof drilling bits. For example, it would be desirable to provide an improved roof drill bit that facilitates the prompt completion of the roof bolting process. It would also be desirable to provide an improved roof drill bit that has a longer useful life. It would also be desirable to provide an improved roof drill bit that has an increased penetration rate.

SUMMARY OF THE INVENTION

In accordance with an aspect of the invention, a rotary drill bit for engaging an earth strata material includes an elongate drill bit body having an axial forward end and an axial rearward end, and a cutting insert attached to the axial forward end of the elongate drill bit body, the cutting insert having an elongate insert body rotatable about a central axis. The elongate insert body includes a pair of symmetrical halves symmetrical about the central axis, each symmetrical half comprising: a leading face; a top surface having a relief surface; a T-land surface extending between the leading face and the relief surface of the top surface; and a cutting edge formed at the intersection of the T-land surface and the relief surface of the top surface. In one aspect, the cutting edge has a negative axial rake angle. In another aspect, the relief surface includes a primary relief surface and a secondary relief surface.

In accordance with another aspect of the invention, a cutting insert for use in connection with a rotary drill bit for engaging an earth strata material includes an elongate insert body rotatable about a central axis. The elongate insert body includes a pair of symmetrical halves symmetrical about the central axis, each symmetrical half comprising: a leading face; a top surface having a primary relief surface and a secondary relief surface; a T-land surface extending between the leading face and the primary relief surface of the top surface; and a cutting edge formed at the intersection of the T-land surface and the primary relief surface of the top surface. In one aspect, the cutting edge has a negative axial rake angle.

In accordance with another aspect of the invention, a cutting insert for use in connection with a rotary drill bit for engaging an earth strata material includes an elongate insert body rotatable about a central axis. The elongate insert body includes a pair of symmetrical halves symmetrical about the central axis, each symmetrical half comprising: a leading face; a top surface having a relief surface; a T-land surface extending between the leading face and the relief surface of the top surface; and a cutting edge formed at the intersection of the T-land surface and the relief surface of the top surface. In one aspect, the cutting edge has a negative axial rake angle.

In accordance with yet another aspect of the invention, a rotary drill bit for engaging an earth strata material includes an elongate drill bit body having an axial forward end and an axial rearward end, and a cutting insert attached to the axial forward end of the elongate drill bit body, the cutting insert having an elongate insert body rotatable about a central axis. The elongate insert body includes a pair of symmetrical halves symmetrical about the central axis, each symmetrical half comprising: a leading face; a top surface having a relief surface; a T-land surface extending between the leading face and the relief surface of the top surface; and a rounded cutting edge formed at the intersection of the T-land surface and the relief surface of the top surface. In one aspect, the rounded cutting edge has a negative axial rake angle. In another aspect, the relief surface includes a primary relief surface and a secondary relief surface. In another aspect, the leading face and the T-land surface intersect to form a rounded leading edge.

These and other aspects of the present invention will be more fully understood following a review of this specification and drawings.

DETAILED DESCRIPTION

The following description is for purposes of illustrating various aspects of the invention only and not for purposes of limiting the scope of the invention.

Figure 1:
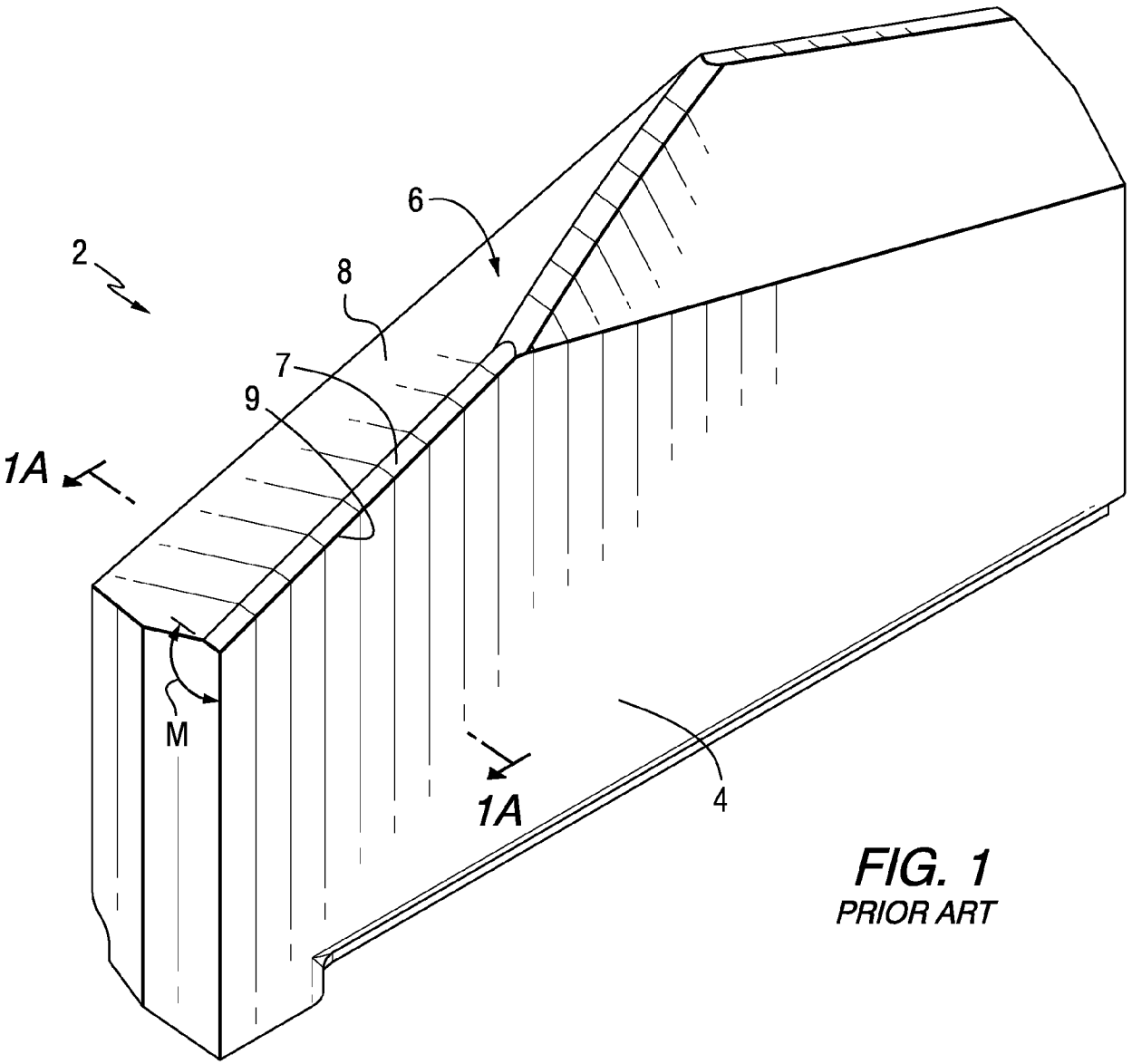
FIG. 1 PRIOR ART
FIG. 1 is an isometric view of a known cutting insert.
Figure 1A:
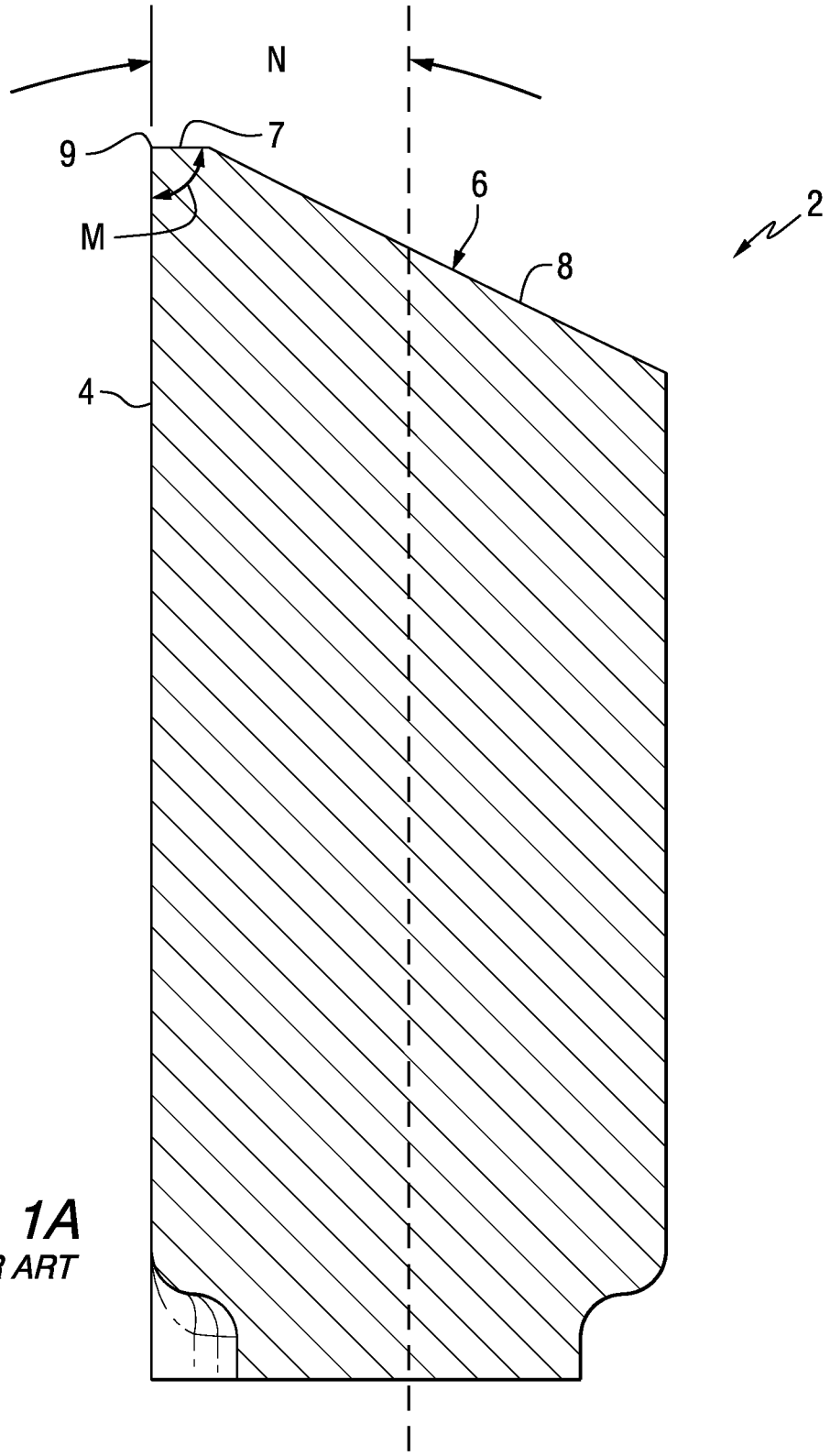
FIG. 1A PRIOR ART
FIG. 1A is a sectional view taken along line 1A-1A of the known cutting insert shown in FIG. 1.
Figure 1B:
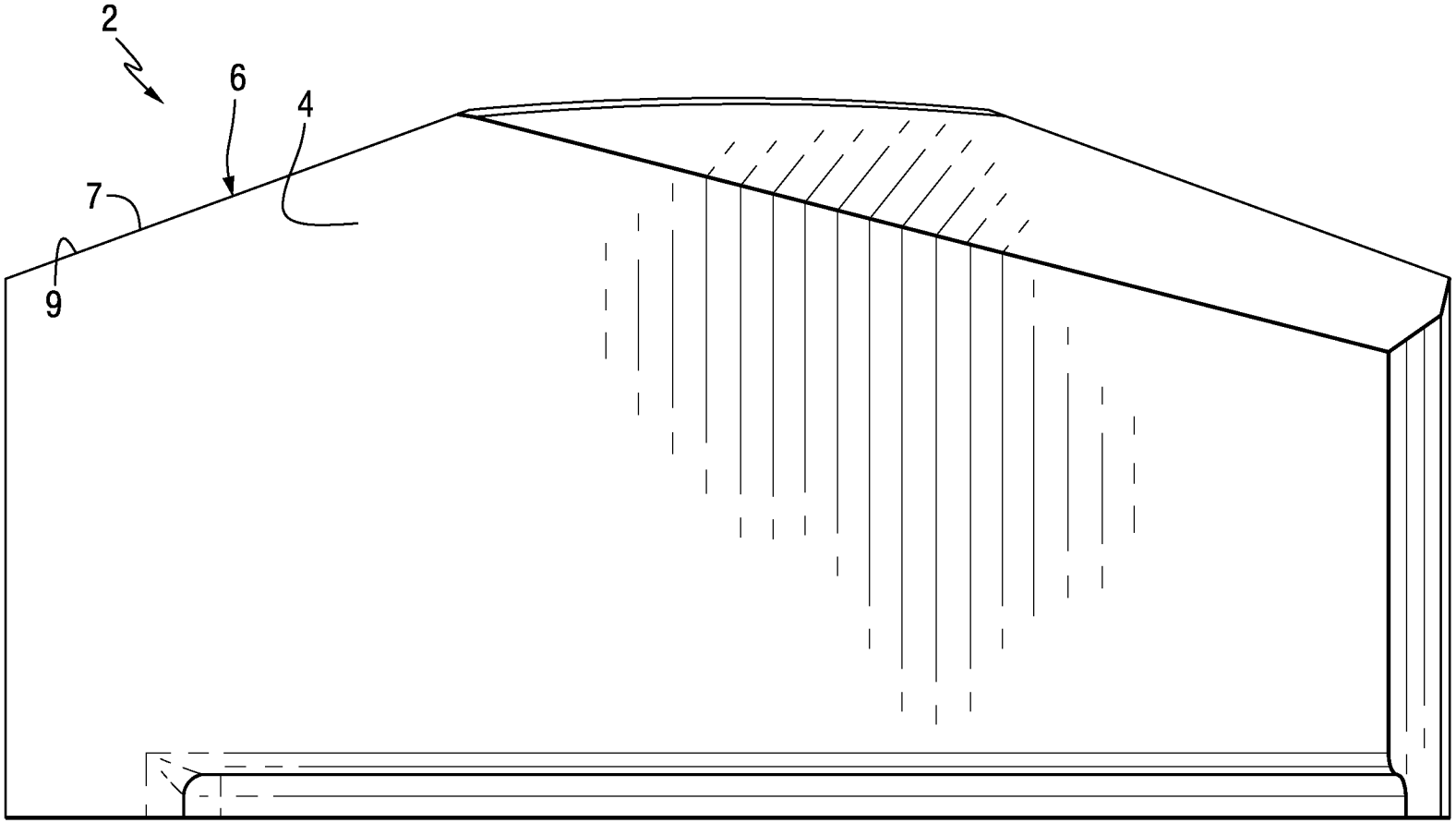
FIG. 1B PRIOR ART
FIG. 1B is a front view of the known cutting insert shown in FIGS. 1 and 1A.
Figure 2:
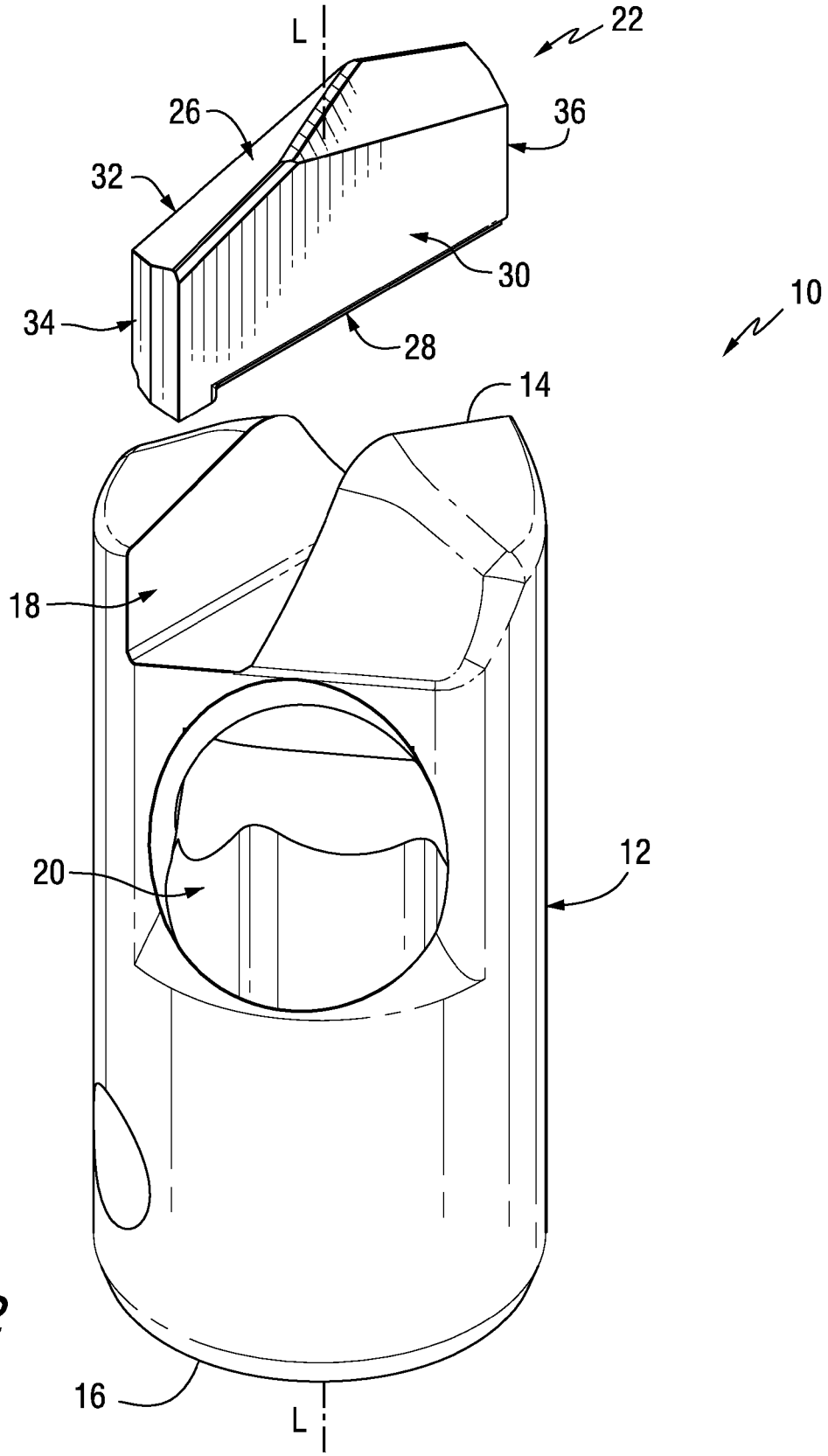
FIG. 2 is an exploded assembly view of a rotary drill bit, e.g. a roof drill bit, in accordance with an aspect of the invention.
Figure 3:
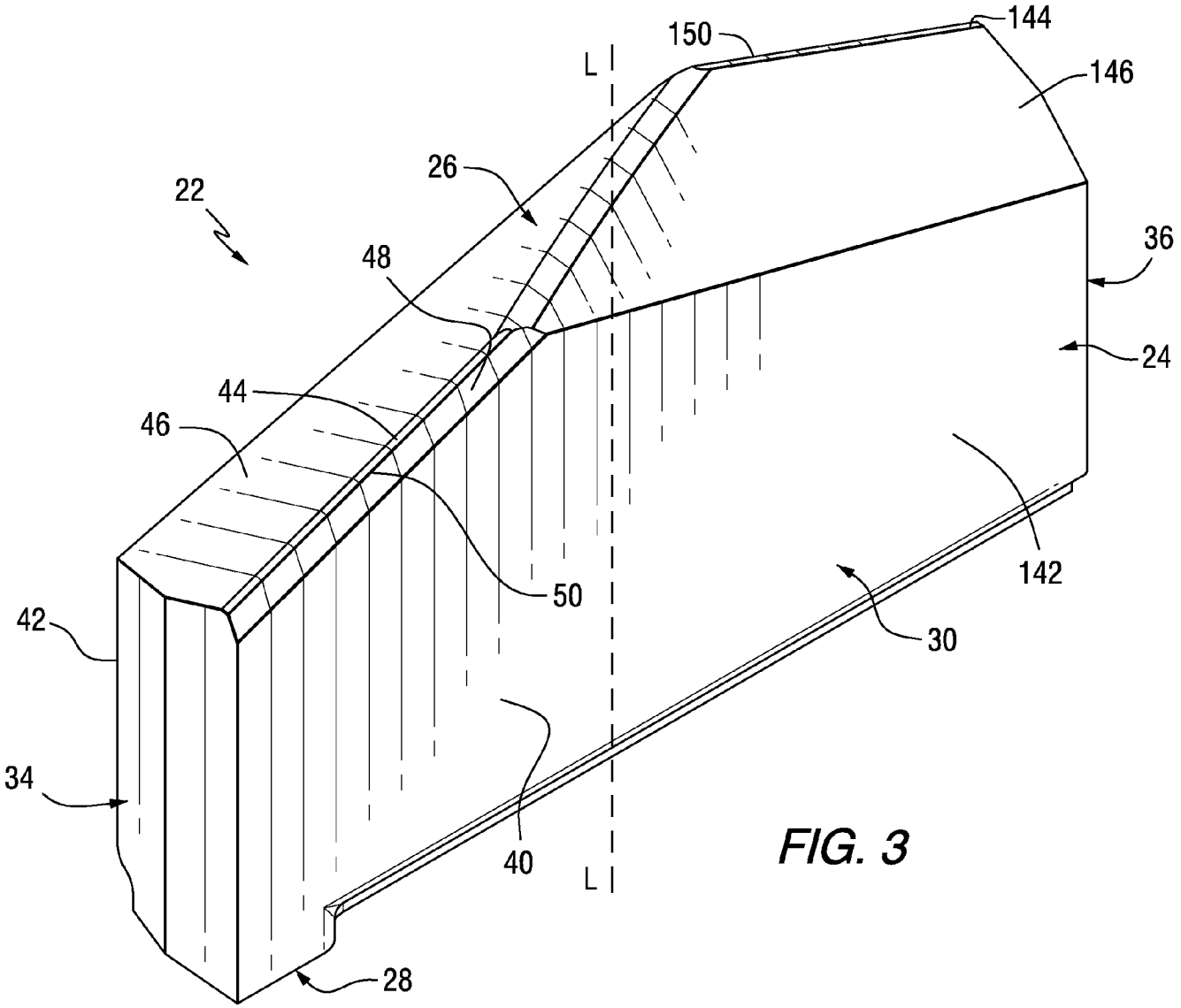
FIG. 3 is an isometric view of a cutting insert shown in FIG. 2, in accordance with an aspect of the invention.
Figure 4:
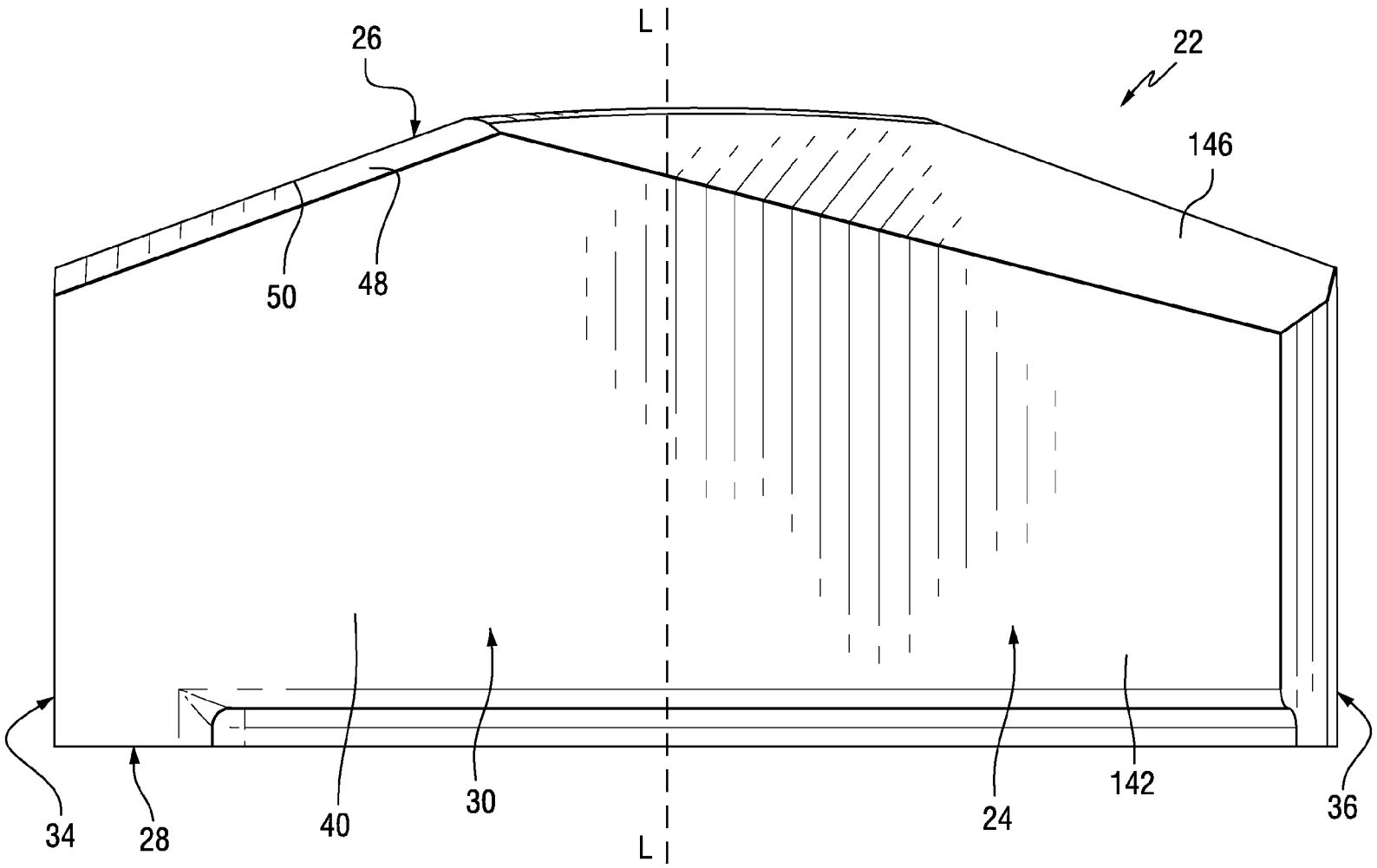
FIG. 4 is a front elevational view of the cutting insert shown in FIGS. 2 and 3, in accordance with an aspect of the invention.

Referring to the drawings, FIG. 2 illustrates a rotary drill bit in the form of a roof drill bit generally designated as 10. Roof drill bit 10 has an elongate drill bit body 12 typically made of, for example, steel. Drill bit body 12 presents a generally cylindrical geometry. Drill bit body 12 has an axial forward end 14 and an axial rearward end 16. Drill bit body 12 contains a transverse slot 18 in the axial forward end thereof 14. Drill bit body 12 also may include a debris evacuation or collection port 20 that is mediate between the axial forward end 14 and the axial rearward end 16. During the drilling operation, dirt and debris may pass through the port 20.

The roof drill bit 10 also includes a cutting insert (or rotary drill bit insert) 22 (see FIGS. 2-5A) that is positioned within the transverse slot 18 and the insert 22 is typically affixed therein by, for example, attaching mechanically or otherwise, via brazing, gluing, or press fitting using conventional compositions and techniques known to those skilled in the art. The roof drill bit 10 and the cutting insert 22 have a central longitudinal axis L-L wherein the roof drill bit 10 and the cutting insert 22 are rotatable about the central axis L-L. The cutting insert 22 is made from, for example, a cemented tungsten carbide that is a mixture of cobalt and tungsten carbide. Other super hard, wear resistant materials such as polycrystalline diamond, ceramics, or cermet may be used as a supplement and/or substitute. For example chromium carbide-coated metals and other cermets where titanium carbide or vanadium carbide is added to tungsten carbide may be candidates for inserts materials in accordance to aspects of the invention. Alternate ceramics for such applications include aluminum-based, silicon based, zirconium-based and glass varieties. Still other insert materials alternatives include cubic refractory, transition metal carbides or any other known or subsequently developed material(s) harder than the base material. Also coatings of the inserts such as PVD or CVD coatings can be used.

Cutting insert 22 has a cutting insert body, generally designated as 24, that has a top surface generally designated as 26, a bottom surface generally designated as 28, opposite side surfaces generally designated as 30 and 32, and opposite end surfaces generally designated as 34 and 36. The cutting insert body 24 is structured and arranged into two opposite symmetric connected portions, i.e. a pair of symmetrical halves, which are symmetric about the central axis L-L; namely, one symmetric portion generally designated by bracket 38 and another symmetric portion generally designated by bracket 138 (see, for example, FIG. 5).

Referring to the one symmetric portion 38, there is a leading face 40 and an opposite rearward or trailing face 42. In one aspect, the top surface 26 includes a primary relief surface 44. In another aspect, the top surface 26 also includes a secondary relief surface 46 wherein the primary relief surface 44 and the secondary relief surface 46 are contiguous and non-coplanar. In another aspect, the secondary relief surface 46 extends from the primary relief surface 44 toward the rearward or trailing face 42 of the cutting insert 22. In another aspect, the secondary relief surface 46 extends from the primary relief surface 44 to the rearward or trailing face 42.

In accordance with another aspect of the invention, the portion 38 of the cutting insert 22 includes edge preparation such as a T-land surface, generally designated as 48, extending generally between the leading face 40 and the primary relief surface 44 of the top surface 26. In one aspect, the T-land surface 48 is a planar surface. In another aspect, the T-land surface 48 is contiguous and non-coplanar with the leading face 40. In another aspect, the T-land surface 48 is contiguous and non-coplanar with the primary relief surface 44.

The portion 38 of the cutting insert 22 further includes a cutting edge 50 formed at the intersection of the T-land surface 48 and the primary relief surface 44 of the top surface 26. This configuration of having the cutting edge 50 formed at the intersection of the T-land surface 48 and the primary relief surface 44 provides for the cutting edge 50 to have a negative axial rake angle R (see, for example, FIG. 5A). In one aspect, the negative axial rake angle R is in the range of about 10 degrees to about 40 degrees. In one specific example, the rake angle R shown in FIG. 5A is about negative 25 degrees.

Figure 5:
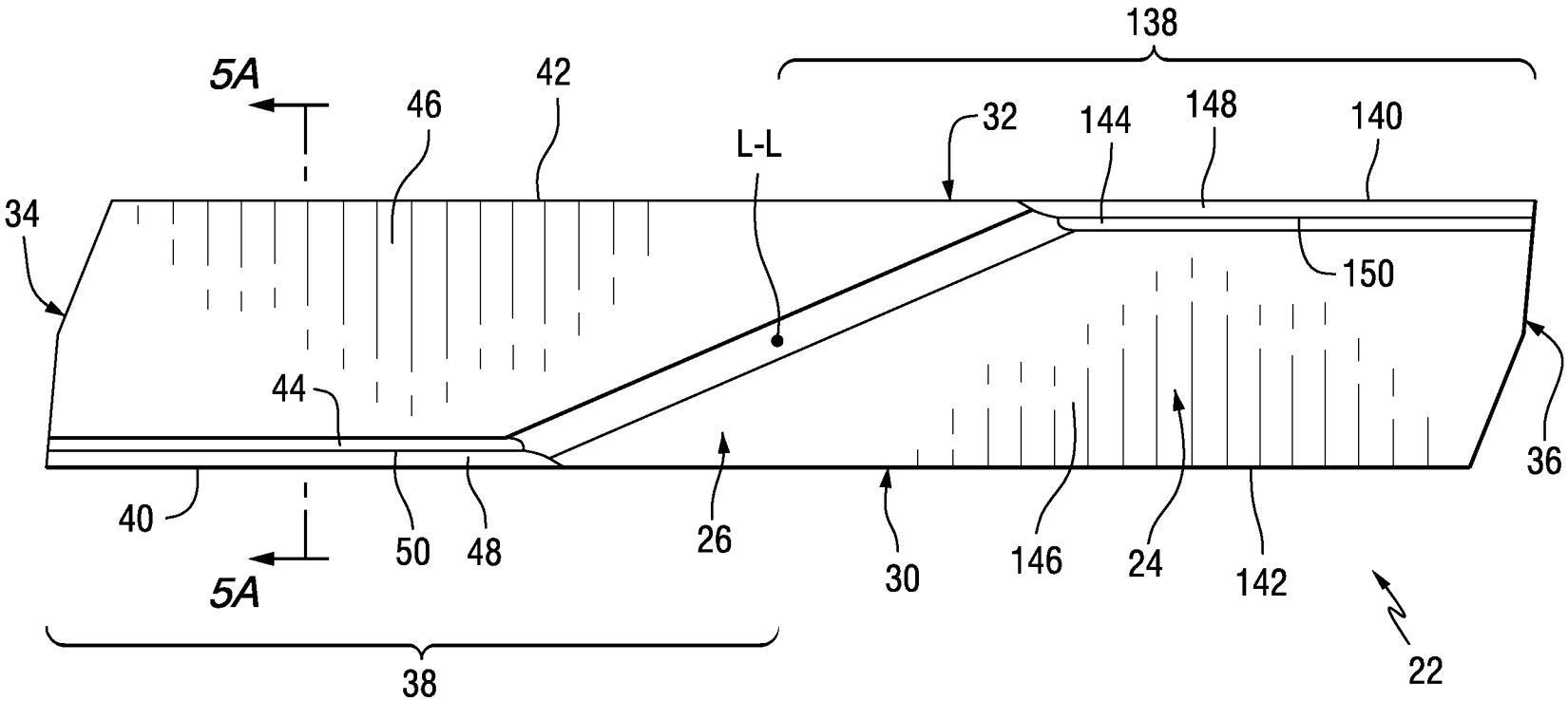
FIG. 5 is a top plan view of the cutting insert shown in FIGS. 2, 3 and 4, in accordance with an aspect of the invention.
Figure 5A:
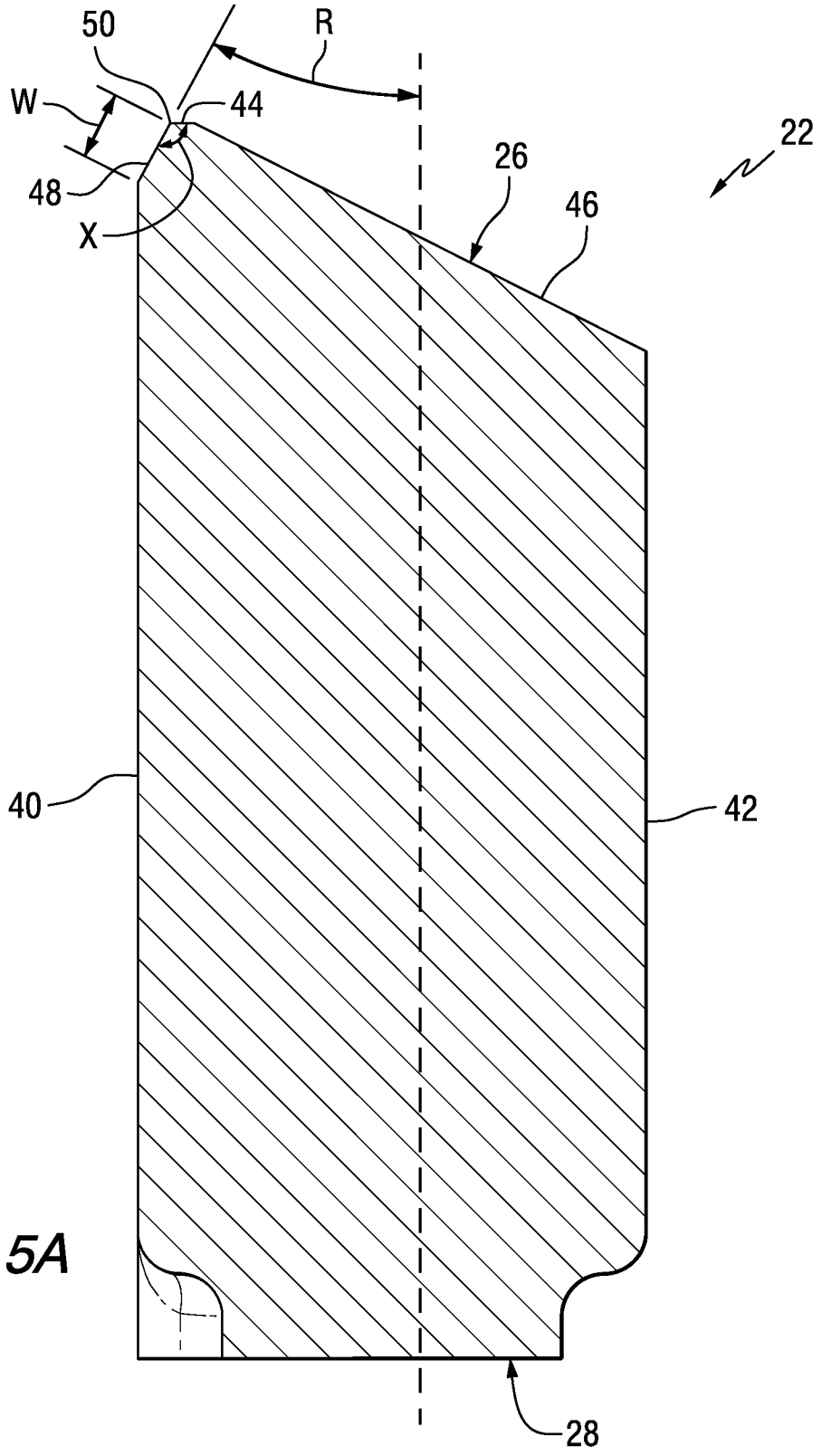
FIG. 5A is a sectional view taken along line 5A-5A of FIG. 5, in accordance with another aspect of the invention.

The T-land surface 48 is positioned relative to the primary relief surface 44 at an angle X (see, for example, FIG. 5A). The angle X may be referred to as a relief angle relative to or in relation to cutting edge 50. In one aspect, the T-land surface 48 is positioned relative to the primary relief surface 44 at an angle X that is greater than 90 degrees. In one specific example, the angle X shown in FIG. 5A is about 115 degrees.

In another aspect, the T-land surface 48 may have a width W (see, for example, FIG. 5A) in the range of about 0.002 inches to about 0.090 inches. In one specific example, the width W is about 0.010 inches.

It will be appreciated that the described configuration of the T-land 48, cutting edge 50, negative axial rake angle R and/or the relief angle X individually and/or in combination advantageously avoid a sharp transition for the cutting edge 50 so as to reduce or minimize the possibility of the cutting edge 50 breaking or chipping during operation of the roof drill bit 10. In addition, the T-land 48 is configured so as to redirect the cutting forces along the cutting edge to reduce the shear stress along the cutting edge.

Referring to the other symmetric portion 138 of the cutting insert 22, the portion 138 is the same or identical to the portion 38 as described herein. More particularly, the portion 138 includes a leading face 140 and an opposite rearward or trailing face 142. In one aspect, the top surface 26 includes a primary relief surface 144. In another aspect, the top surface 26 also includes a secondary relief surface 146 wherein the primary relief surface 144 and the secondary relief surface 146 are contiguous and non-coplanar. In another aspect, the secondary relief surface 146 extends from the primary relief surface 144 toward the rearward or trailing face 142 of the cutting insert 22. In another aspect, the secondary relief surface 146 extends from the primary relief surface 44 to the rearward or trailing face 142.

In accordance with another aspect of the invention, the portion 138 of the cutting insert 22 includes a T-land surface, generally designated as 148, extending generally between the leading face 140 and the primary relief surface 144 of the top surface 26. In one aspect, the T-land surface 148 is a planar surface. In another aspect, the T-land surface 148 is contiguous and non-coplanar with the leading face 140. In another aspect, the T-land surface 148 is contiguous and non-coplanar with the primary relief surface 144.

The portion 138 of the cutting insert 22 further includes a cutting edge 150 formed at the intersection of the T-land surface 148 and the primary relief surface 144 of the top surface 26. This configuration of having the cutting edge 150 formed at the intersection of the T-land surface 148 and the primary relief surface 144 provides for the cutting edge 150 to have a negative axial rake angle (not shown). It will be appreciated that the negative axial rake angle for the portion 138 is the same as negative axial rake angle R, as described herein and illustrated herein. In one aspect, the negative axial rake angle is in the range of about 10 degrees to about 40 degrees. In one specific example, the rake angle is about negative 25 degrees.

The T-land surface 148 is positioned relative to the primary relief surface 44 at an angle (same as angle X shown, for example, in FIG. 5A and described herein), which may be referred to as a relief angle for the cutting edge 150. In one aspect, the T-land surface 148 is positioned relative to the primary relief surface 144 at a relief angle that is greater than 90 degrees. In one specific example, the relief angle is about 115 degrees.

It will be appreciated that the described configuration of the T-land 148, cutting edge 150, negative axial rake angle and/or the relief angle individually and/or in combination advantageously avoid a sharp transition for the cutting edge 150 so as to reduce or minimize the possibility of the cutting edge 150 breaking or chipping during operation of the roof drill bit 10.

The Cutting insert 22 is made, for example, with a powder metallurgy process using a press comprising of a die and top and bottom ram/punch to press the complete shape. Parts can be pressed to finished shape or modified with a wet/dry blast, or diamond ground other material shaping processes such as but not limited to EDM (electrical discharge machining), EDG (electrical discharge grinding), green machining, laser ablation into final shapes. Advantageously, the invention provides for moving the critical cutting edge of the insert from the intersection of the die case and ram during manufacturing. In accordance with an aspect of the invention, the critical cutting edge is now formed entirely in the ram/punch. This eliminates the flash from forming on the cutting edge. Flash is undesirable because, for example, it is a stress concentrator. It will be appreciated that these and other aspects of the invention as set forth herein contribute to the desired edge, i.e. cutting edge, preparation for the cutting insert.

Figure 6:
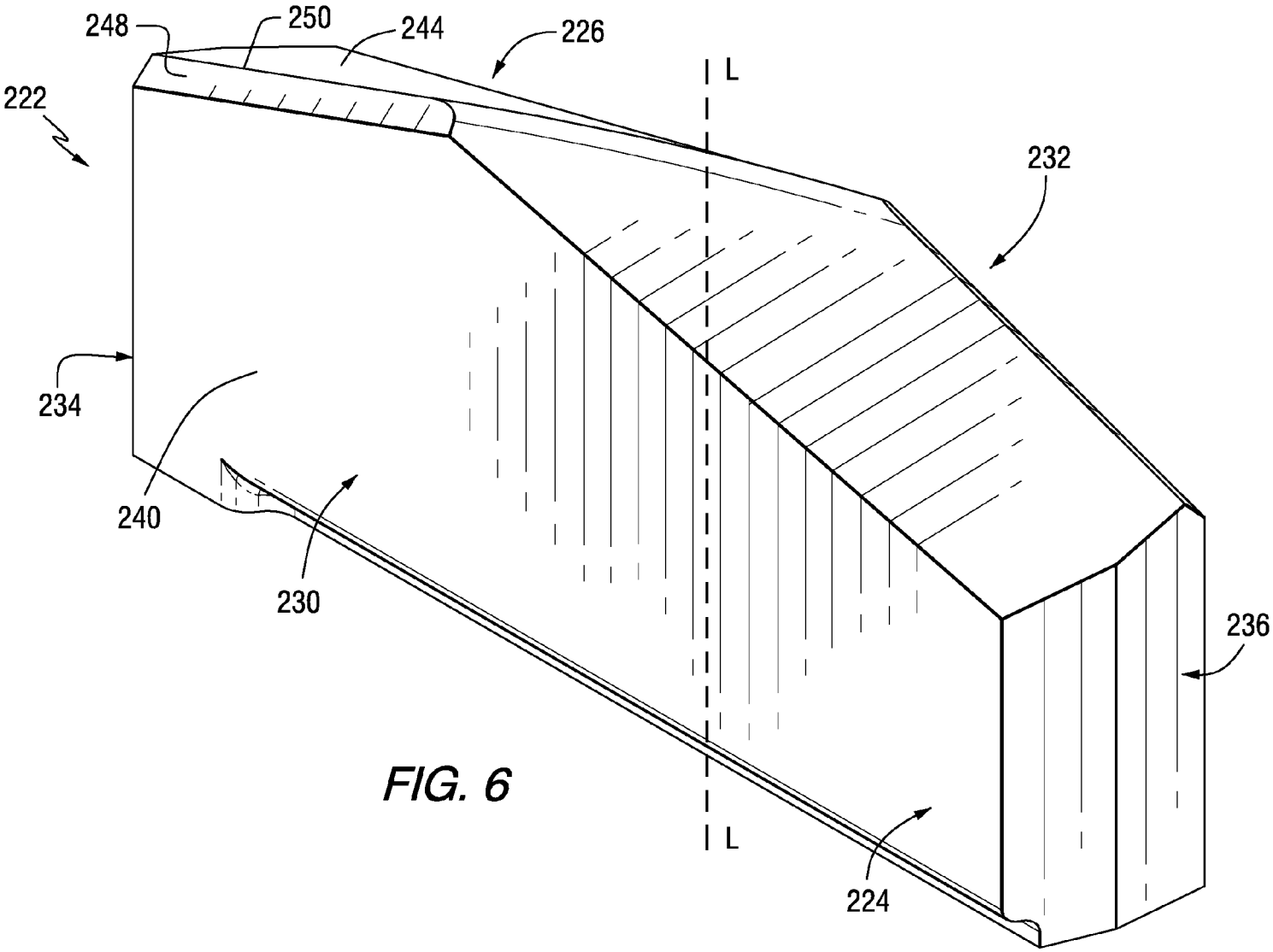
FIG. 6 is an isometric view of an additional cutting insert, in accordance with an aspect of the invention.
Figure 7:
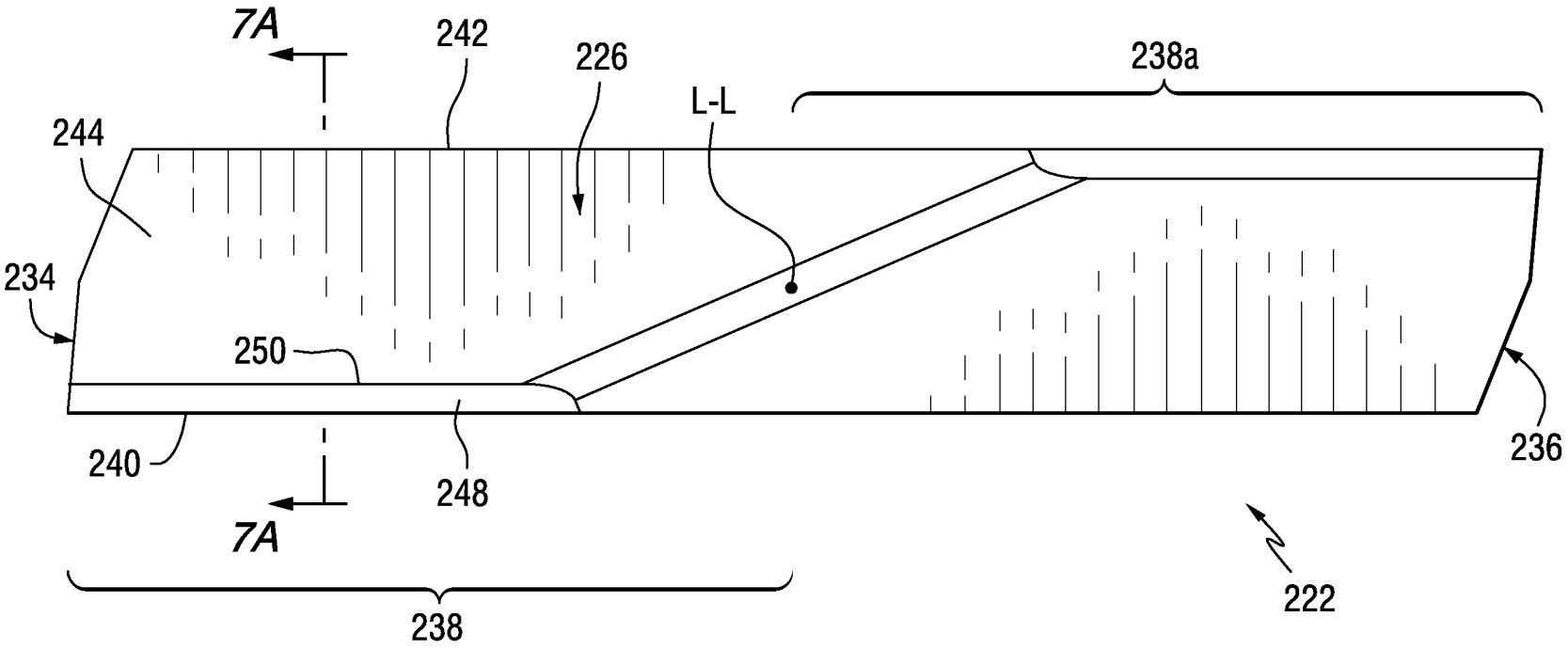
FIG. 7 is a top plan view of the cutting insert shown in FIG. 6, in accordance with an aspect of the invention.
Figure 7A:
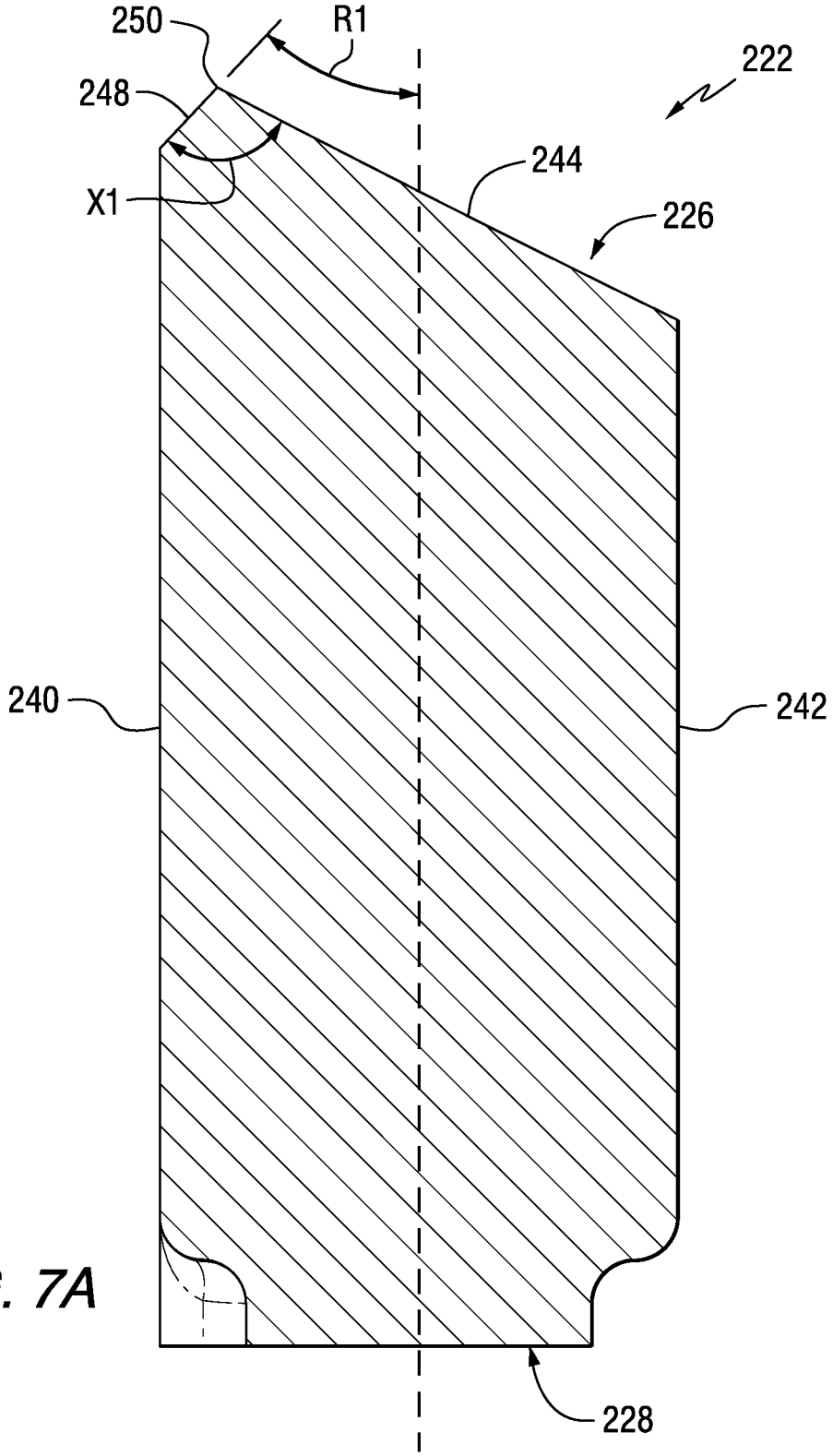
FIG. 7A is a sectional view taken along line 7A-7A of FIG. 7, in accordance with another aspect of the invention.

Referring to FIGS. 6-7A, there is illustrated an additional cutting insert 222, in accordance with another aspect of the invention. Cutting insert 222 has a cutting insert body, generally designated as 224, that has a top surface generally designated as 226, a bottom surface generally designated as 228, opposite side surfaces generally designated as 230 and 232, and opposite end surfaces generally designated as 234 and 236. The cutting insert body 224 is structured and arranged into two opposite symmetric connected portions, i.e. a pair of symmetrical halves, which are symmetric about the central axis L-L; namely, one symmetric portion generally designated by bracket 238 and another symmetric portion generally designated by bracket 238A (see, for example, FIG. 7). It will be appreciated that the symmetric portion 238A of the cutting insert 222 is the same or identical to the portion 238 which will be described in detail herein.

Referring to the symmetric portion 238, there is a leading face 240 and an opposite rearward or trailing face 242. In one aspect, the top surface 226 includes a relief surface 244. In contrast to the cutting insert 22 described herein, the top surface 26 does not include a secondary or additional relief surface. In another aspect, the relief surface 244 extends to the rearward or trailing face 242.

In accordance with another aspect of the invention, the portion 238 of the cutting insert 222 includes a T-land surface, generally designated as 248, extending generally between the leading face 240 and the relief surface 244 of the top surface 226. In one aspect, the T-land surface 248 is a planar surface. In another aspect, the T-land surface 248 is contiguous and non-coplanar with the leading face 240. In another aspect, the T-land surface 248 is contiguous and non-coplanar with the relief surface 244.

Figure 7B:
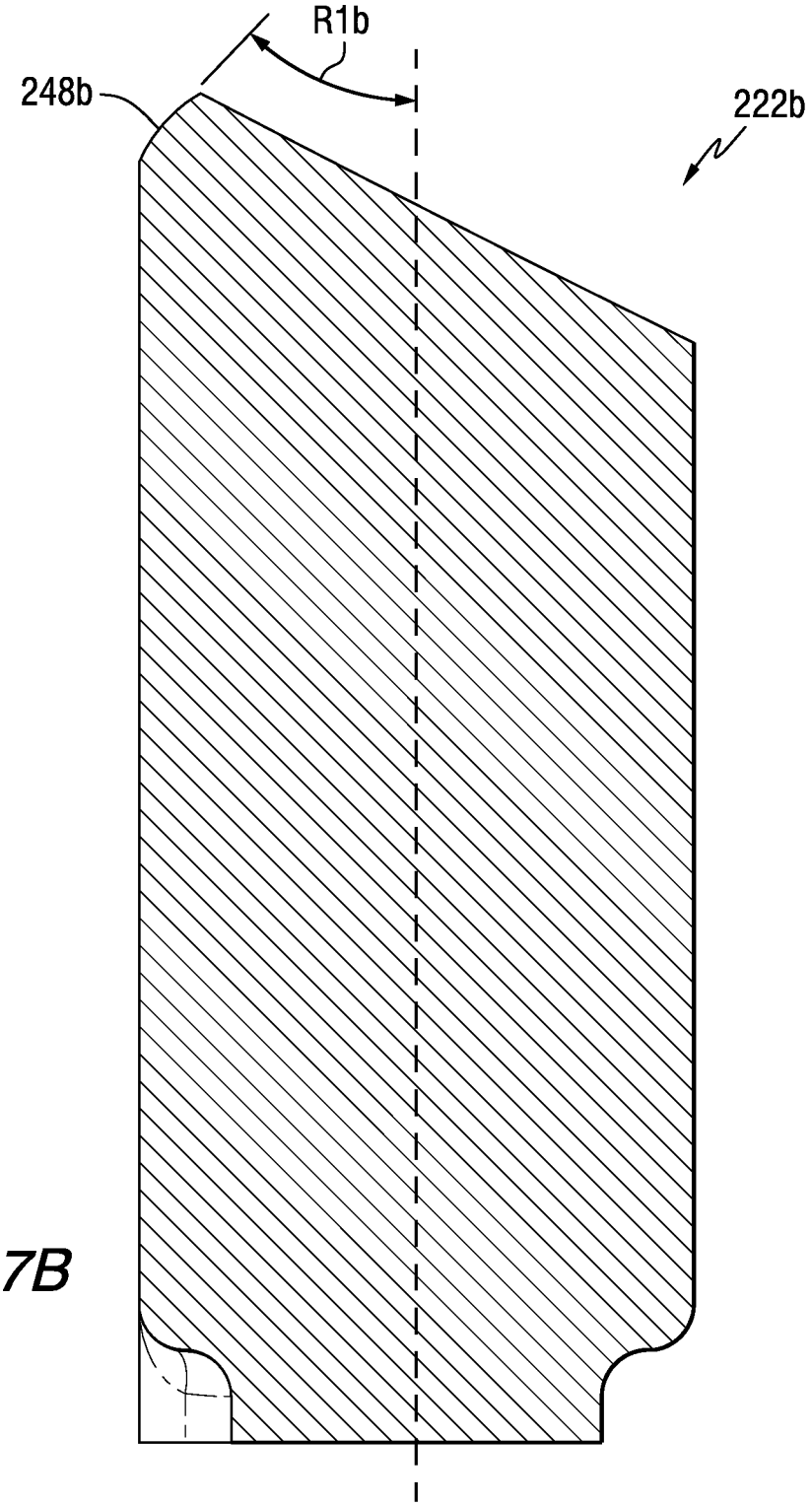
FIG. 7B is a sectional view similar to FIG. 7A but showing an additional cutting insert, in accordance with another aspect of the invention.

FIG. 7B illustrates an additional cutting insert 222*b*, in accordance with another aspect of the invention. Cutting insert 222*b* is similar to cutting insert 222 except that cutting insert 222*b* includes a rounded or curved, i.e. non-planar, T-land surface 248*b*. Cutting insert 222*b* still includes a negative axial rake angle R1*b*.

The portion 238 of the cutting insert 222 further includes a cutting edge 250 formed at the intersection of the T-land surface 248 and the relief surface 244. This configuration of having the cutting edge 250 formed at the intersection of the T-land surface 248 and the relief surface 244 provides for the cutting edge 250 to have a negative axial rake angle R1 (see, for example, FIG. 7A). In one aspect, the negative axial rake angle R1 is in the range of about 10 degrees to about 40 degrees. In one specific example, the rake angle R1 shown in FIG. 7A is about negative 25 degrees.

The T-land surface 248 is positioned relative to the relief surface 244 at an angle X1 (see, for example, FIG. 7A). The angle X1 may be referred to as a relief angle relative to or in relation to the cutting edge 250. In one aspect, the T-land surface 248 is positioned relative to the relief surface 244 at an angle X1 that is greater than or equal to 90 degrees. In one specific example, the angle X1 shown in FIG. 7A is about 95 degrees.

It will be appreciated that the described configuration of the T-land 248, cutting edge 250, negative axial rake angle R1 and/or the relief angle X1 individually and/or in combination advantageously avoid a sharp transition for the cutting edge 250 so as to reduce or minimize the possibility of the cutting edge 250 breaking or chipping during operation of the roof drill bit 10.

Figure 8:
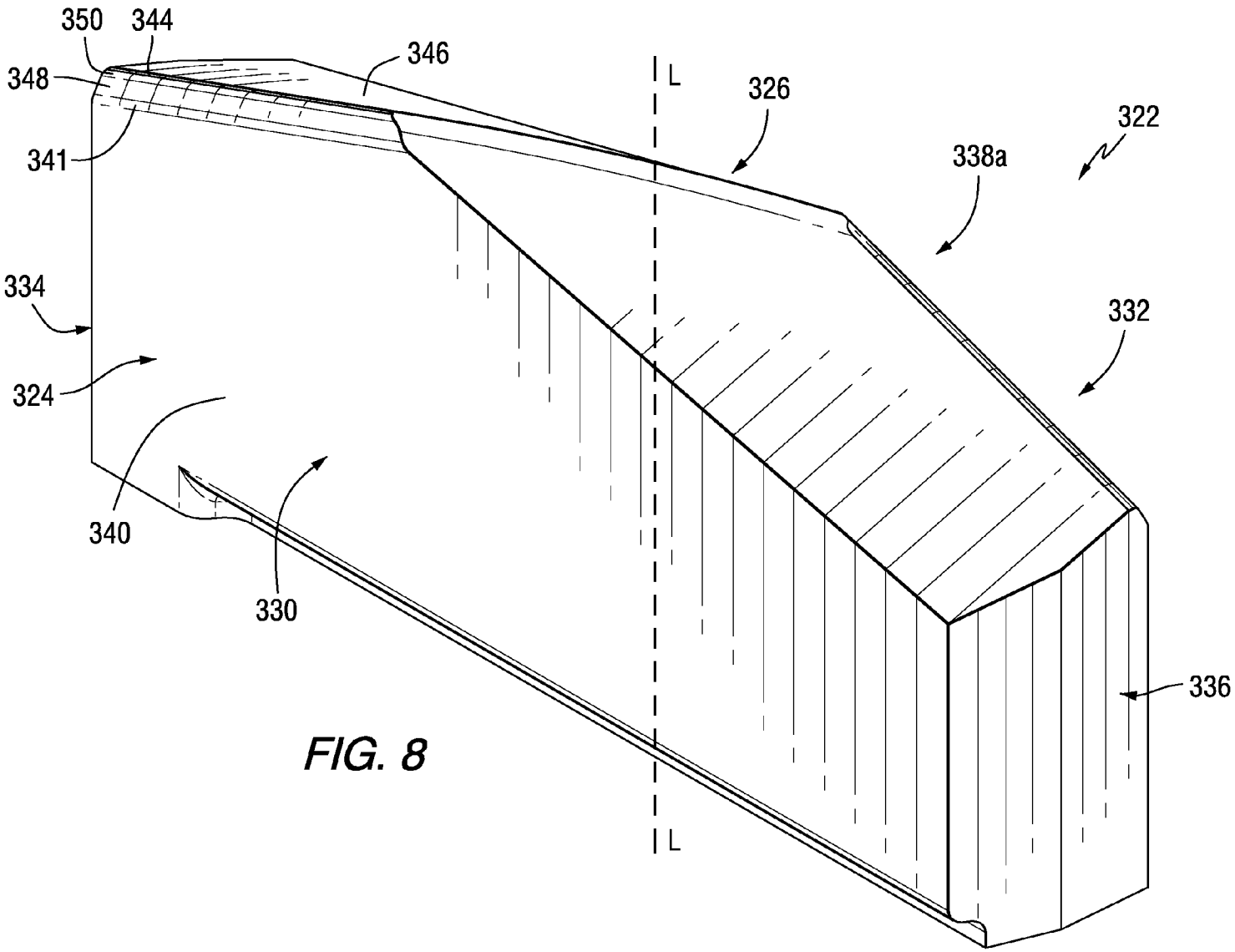
FIG. 8 is an isometric view of an additional cutting insert, in accordance with an aspect of the invention.
Figure 9:
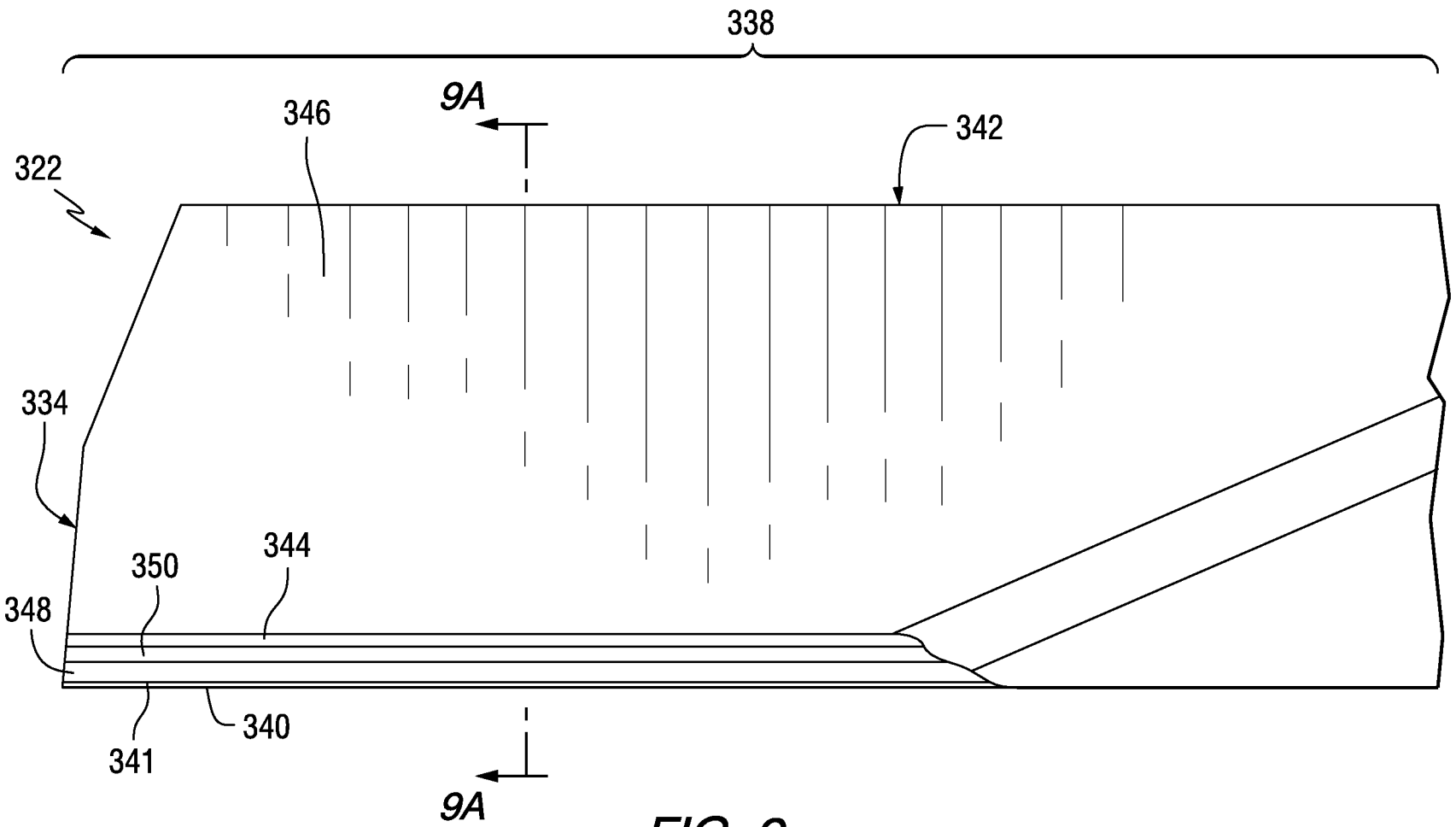
FIG. 9 is a top plan view of the cutting insert shown in FIG. 8, in accordance with an aspect of the invention.
Figure 9A:
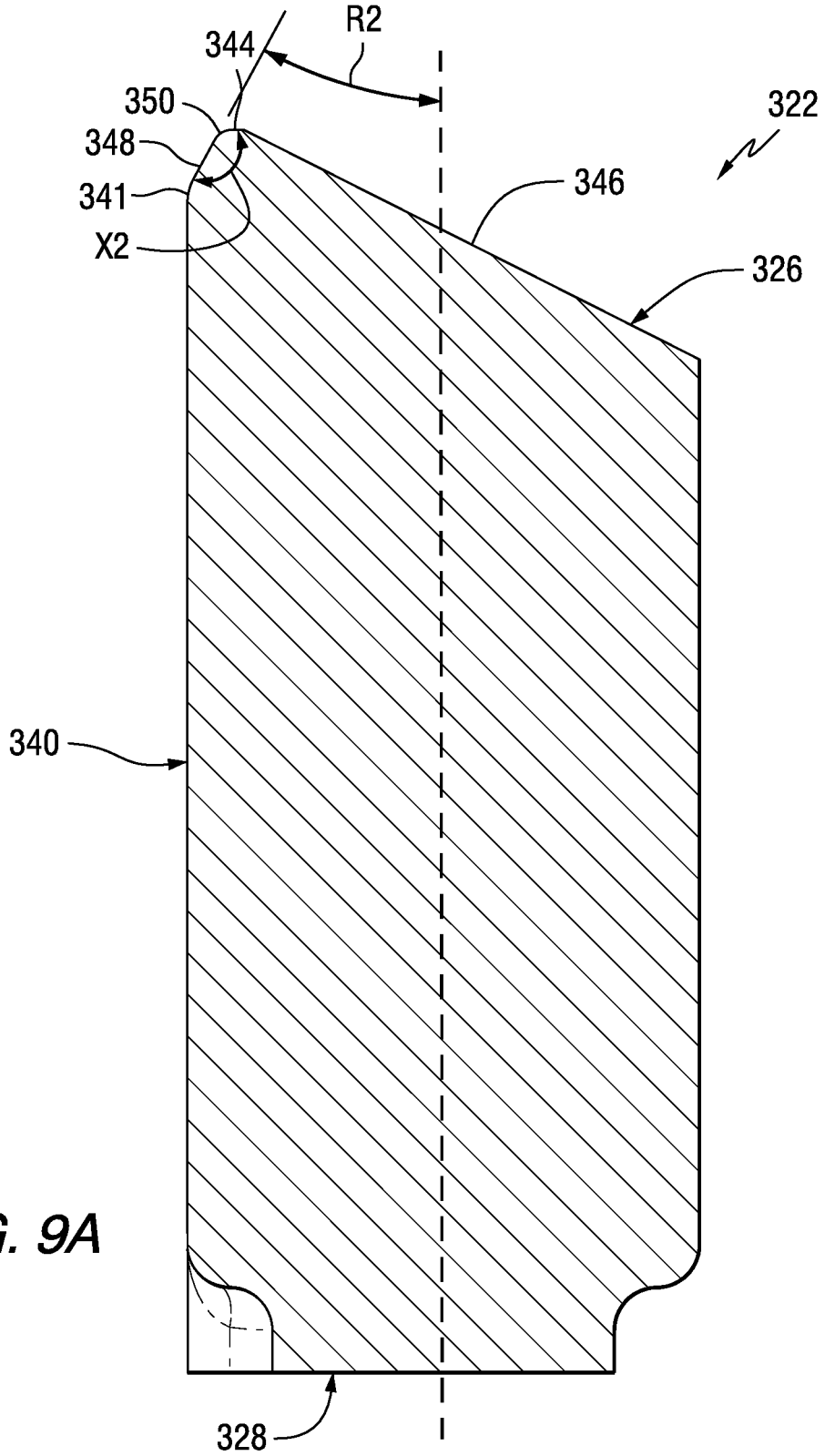
FIG. 9A is a sectional view taken along line 9A-9A of FIG. 9, in accordance with another aspect of the invention.

Referring to FIGS. 8-9A, there is illustrated an additional cutting insert 322, in accordance with another aspect of the invention. Cutting insert 322 has a cutting insert body, generally designated as 324, that has a top surface generally designated as 326, a bottom surface generally designated as 328, opposite side surfaces generally designated as 330 and 332, and opposite end surfaces generally designated as 334 and 336. The cutting insert body 324 is structured and arranged into two opposite symmetric connected portions, i.e. a pair of symmetrical halves, which are symmetric about the central axis L-L; namely, one symmetric portion generally designated by bracket 338 (see, for example, FIG. 9) and another symmetric portion generally designated by reference number 338A (see, for example, FIG. 8). It will be appreciated that the symmetric portion 338A of the cutting insert 322 is the same or identical to the portion 338 which will be described in detail herein.

Referring to the symmetric portion 338, there is a leading face 340 and an opposite rearward or trailing face 342. In one aspect, the top surface 326 includes a primary relief surface 344. In another aspect, the top surface 326 also includes a secondary relief surface 346 wherein the primary relief surface 344 and the secondary relief surface 346 are contiguous and non-coplanar. In another aspect, the secondary relief surface 346 extends from the primary relief surface 344 toward the rearward or trailing face 342 of the cutting insert 322. In another aspect, the secondary relief surface 346 extends from the primary relief surface 344 to the rearward or trailing face 342. While the primary relief surface 344 and the secondary relief surface 346 are shown, it will be appreciated that the insert 322 may include a single relief surface or more than two relief surfaces in accordance with aspects of the invention.

In accordance with another aspect of the invention, the portion 338 of the cutting insert 322 includes a T-land surface, generally designated as 348, extending generally between the leading face 340 and the relief surface 344 of the top surface 326. In one aspect, the T-land surface 348 is a planar surface. In another aspect, the T-land surface 348 is contiguous and non-coplanar with the leading face 340. In another aspect, the T-land surface 348 is contiguous and non-coplanar with the relief surface 344.

The portion 338 of the cutting insert 322 further includes a rounded cutting edge 350 formed at the intersection of the T-land surface 348 and the relief surface 344. In another aspect, the leading face 340 and the T-land 348 intersect to form a rounded leading edge 341.

The configuration of having the rounded cutting edge 350 formed at the intersection of the T-land surface 348 and the relief surface 344 provides for the cutting edge 350 to have a negative axial rake angle R2 (see, for example, FIG. 9A). In one aspect, the negative axial rake angle R2 is in the range of about 10 degrees to about 40 degrees. In one specific example, the rake angle R2 shown in FIG. 9A is about negative 25 degrees.

The T-land surface 348 is positioned relative to the relief surface 344 at an angle X2 (see, for example, FIG. 9A). The angle X2 may be referred to as a relief angle relative to or in relation to the rounded cutting edge 350. In one aspect, the T-land surface 348 is positioned relative to the primary relief surface 344 at an angle X2 that is greater than 90 degrees. In one specific example, the angle X2 shown in FIG. 9A is about 115 degrees.

Whereas particular aspects of this invention have been described above for purposes of illustration, it will be evident to those skilled in the art that numerous variations of the details of the present invention may be made without departing from the invention as defined in the appended claims.

What is claimed is:

1. A rotary drill bit for engaging an earth strata material, the rotary drill bit comprising:

an elongate drill bit body having an axial forward end and an axial rearward end; and a cutting insert attached to the axial forward end of the elongate drill bit body, the cutting insert having an elongate insert body rotatable about a central axis, the elongate insert body having a pair of symmetrical halves symmetrical about the central axis, each symmetrical half comprising:

a leading face;

a top surface having a primary relief surface and a secondary relief surface, wherein the primary relief surface is perpendicular to the leading face;

a T-land surface extending between the leading face and the primary relief surface of the top surface; and a cutting edge formed at the intersection of the T-land surface and the primary relief surface of the top surface;

wherein the secondary relief surface extends continuously from the primary relief surface to a rearward face of the cutting insert.

2. The rotary drill bit of claim 1, wherein the cutting edge has a negative axial rake angle.

3. The rotary drill bit of claim 2, wherein the negative axial rake angle is in the range of about 10 degrees to about 40 degrees.

4. The rotary drill bit of claim 1, wherein the T-land surface is positioned relative to the primary relief surface of the top surface at an angle that is about 115 degrees.

5. The rotary drill bit of claim 1, wherein the primary relief surface and the secondary relief surface are contiguous and non-coplanar.

6. The rotary drill bit of claim 1, wherein the T-land surface is positioned relative to the primary relief surface at an angle that is greater than 100 degrees.

7. The rotary drill bit of claim 1, wherein the T-land surface is rounded.

8. The rotary drill bit of claim 1, wherein the cutting edge is rounded.

9. A cutting insert for use in connection with a rotary drill bit for engaging an earth strata material, the cutting insert comprising:

an elongate insert body rotatable about a central axis, the elongate insert body having a pair of symmetrical halves symmetrical about the central axis, each symmetrical half comprising:

a leading face;

a top surface having a primary relief surface and a secondary relief surface, wherein the primary relief surface is perpendicular to the leading face;

a T-land surface extending between the leading face and the primary relief surface of the top surface; and a cutting edge formed at the intersection of the T-land surface and the primary relief surface of the top surface;

wherein the secondary relief surface extends continuously from the primary relief surface to a rearward face of the cutting insert.

10. The cutting insert of claim 9, wherein the cutting edge has a negative axial rake angle.

11. The cutting insert of claim 10, wherein the negative axial rake angle is in the range of about 10 degrees to about 40 degrees.

12. The cutting insert of claim 10, wherein the T-land surface is positioned relative to the primary relief surface at an angle that is about 115 degrees.

13. The cutting insert of claim 12, wherein the primary relief surface and the secondary relief surface are contiguous and non-coplanar.

14. The cutting insert of claim 13, wherein the T-land surface and the primary relief surface are contiguous and non-coplanar.

15. The cutting insert of claim 9, wherein the T-land surface is positioned relative to the primary relief surface at an angle that is greater than 100 degrees.

* * * * *